United States Patent [19]

Roccaforte

[11] 4,252,236

[45] Feb. 24, 1981

[54] CARTON WITH OPENING FOR CONTROLLED DISPENSING

[75] Inventor: Harry I. Roccaforte, Western Springs, Ill.

[73] Assignee: Champion International Corporation, Stamford, Conn.

[21] Appl. No.: 39,124

[22] Filed: May 15, 1979

[51] Int. Cl.[3] ..... B65D 75/58

[52] U.S. Cl. ..... 206/44.12; 206/607

[58] Field of Search ..... 206/44.12, 607, 601, 206/625, 621; 229/7 R, 17 R; 221/305, 309, 307

[56] References Cited

U.S. PATENT DOCUMENTS

| | | | |
|---|---|---|---|
| 1,620,808 | 3/1927 | Eldridge | 206/44.12 |
| 1,716,628 | 6/1929 | Gitteman | 206/44.12 |
| 2,072,695 | 3/1937 | Wellman | 206/44.12 |
| 2,126,106 | 8/1938 | Goldberg | 206/44.12 |
| 2,142,883 | 1/1939 | Chaney et al. | 206/44.12 |
| 2,299,027 | 10/1942 | Novak | 206/44.12 |
| 3,262,632 | 7/1966 | Brady et al. | 206/621 |
| 3,580,478 | 5/1971 | Bemiss | 206/607 X |
| 4,062,486 | 12/1977 | Goodrich | 229/17 R |

FOREIGN PATENT DOCUMENTS

| | | | |
|---|---|---|---|
| 655809 | 5/1965 | Belgium | 206/44.12 |
| 1103502 | 11/1955 | France | 206/44.12 |
| 1434759 | 5/1976 | United Kingdom | 206/44.12 |

*Primary Examiner*—Joseph Man-Fu Moy

*Attorney, Agent, or Firm*—Evelyn M. Sommer

[57] ABSTRACT

A rectangularly shaped carton for containing a plurality of flexible, rectangularly shaped planar articles, such as diapers, in stacked rows therein includes a specially configured dispensing opening in the front wall thereof for controlling the dispensing of the articles therefrom in a manner to prevent inadvertant removal of multiple quantities of the articles. The dispensing opening includes a first and second vertical dimension which are respectively longer and shorter than the longest edge of each of the articles, while the edges of the front wall defining such opening extend oblique to any of the edges of the articles whereby to limit dispensing of the articles to a one-at-a-time basis. A triangular dispensing opening is preferred which is provided with a similarly shaped, tear-away closure panel hingedly connected along the base side thereof to the front wall to permit reclosing the carton.

1 Claim, 10 Drawing Figures

FIG. 5
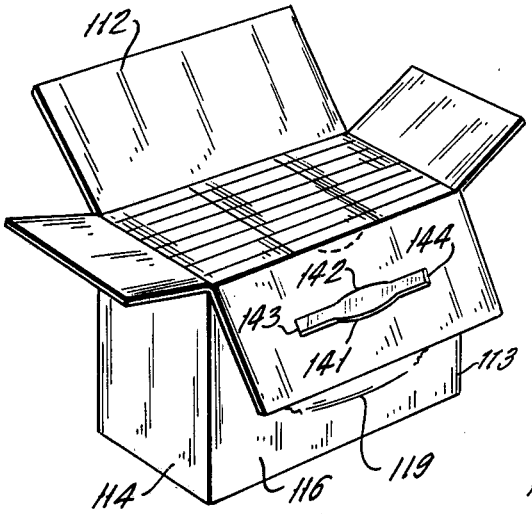
FIG. 6
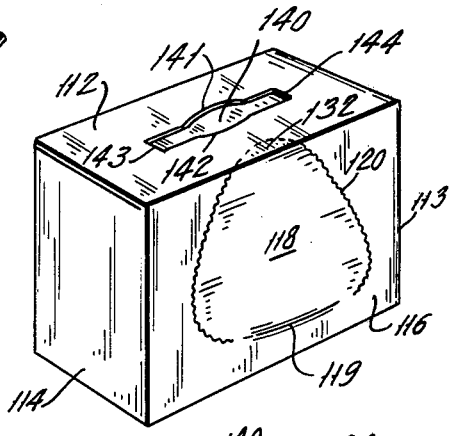
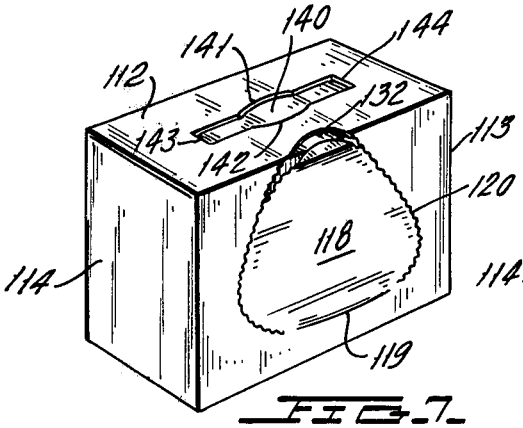
FIG. 7
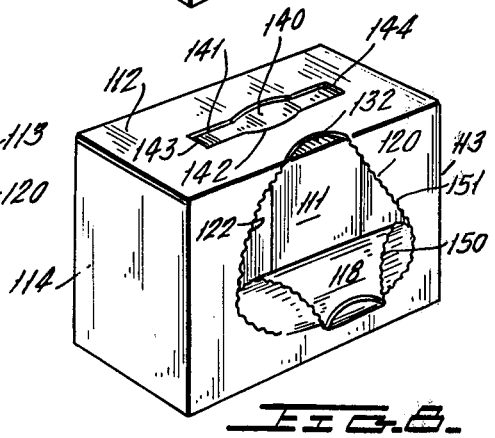
FIG. 8
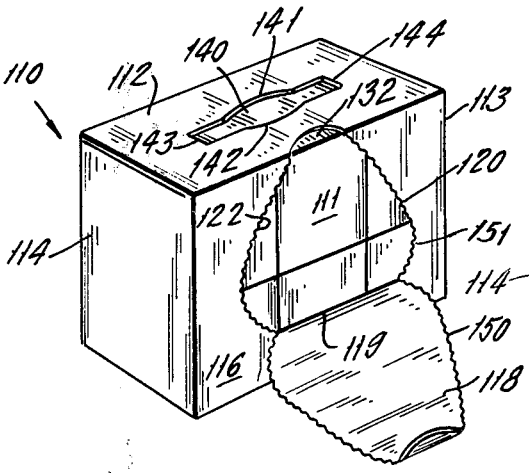
FIG. 9
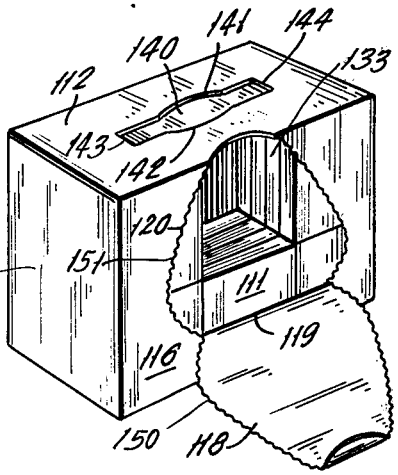
FIG. 10

CARTON WITH OPENING FOR CONTROLLED DISPENSING

TECHNICAL FIELD

This invention generally relates to dispensing cartons and deals more particularly with improvements in a carton of the type having a tear-away closure panel covering a dispensing opening therein.

BACKGROUND AND BRIEF DESCRIPTION OF THE INVENTION

Numerous types of planar articles having a uniform geometrical configuration, such as preformed, rectangularly shaped baby diapers, are often packaged in aligned, face-to-face relationship to each other in stacked rows within a dispensing carton. The carton is provided with a tear-away closure panel which, when removed, provides a substantial dispensing opening in one wall of the carton that places surface areas of each of the planar articles adjacent the dispensing opening within grasp by a user. Thus, the user has ready access to the forward most article in each row thereof to facilitate quick easy removal of individual ones of the articles from the carton.

Heretofore, known prior art cartons have employed a rather large rectangularly shaped dispensing opening whose width and length dimensions exceeded those of each of the rectangularly shaped articles. Consequently, regardless of the placement of the dispensing opening in the side of one of the carton walls, the articles have a tendency to accidentally fall out of the carton through the dispensing opening. Unintended dispensing of articles such as diapers is particularly common where it is necessary to frequently transport the opened cartons from place to place, within diapers bags or the like. Moreover, prior art cartons had a tendency to dispense multiple quantities of the articles therefrom, which added to the inconvenience of such cartons and was particularly annoying to users attempting to change a baby's diaper and having only one hand free to select and withdraw a diaper from the carton.

Consequently, there is a need in the art for a carton of the general type described above which is provided with a dispensing opening that controls the dispensing of articles therefrom in a manner to prevent accidental removal or loss of the articles from an opened carton while at the same time presenting a plurality of articles from which the user may choose and withdraw a single one of the articles so presented. The present invention satisfies this need and eliminates the defficiencies inherent in prior art type carton designs by providing a carton having a tear-away closure panel covering a dispensing opening specially configured and located in one wall of the carton to prevent accidental loss of articles from the carton while presenting at least portions of the face of each of the articles in a stack thereof adjacent the opening to a user in order to allow the user to grasp and withdraw any one of such articles so presented without inadvertantly removing additional quantities of the articles at the same time.

According to the present invention, a rectangularly shaped carton defined by top, bottom, front, back and end walls is adapted to contain a plurality of flexible, planar, rectangularly shaped articles which are arranged in aligned face-to-face abutting relationship to each other and in stacked adjacent rows such that the face of an article in each row thereof opposes the front wall of the carton. A preformed line of weakness in the front wall co-defines a tear-away closure panel and a dispensing opening in the front wall through which articles may be withdrawn from the carton once the closure panel is torn away. The dispensing opening extends vertically and includes at least one vertical dimension greater than the longest edge of the face of one of the planar articles and another vertical dimension less than such longest edge. Edge sections in the front wall defining the dispensing opening extend in a direction oblique with respect to the edges of the articles within the carton and overlap at least portions of the face of each of the articles adjacent the front wall whereby to allow withdrawal of the articles one-at-a-time but prevent unintentional removal of multiple quantities of the articles from the carton. In the preferred form, the dispensing opening and closure panel are triangular in shape while the base side of the closure panel is hingedly connected to the front wall to permit reclosing the dispensing opening. Tear lines in the front wall between the edges defining the dispensing opening and the closure panel are provided with complementary, notched, interlocking extensions which frictionally interlock once the closure panel has been torn away from the front wall and reclosed to relock the closure panel in a closed position covering the dispensing opening. One apex of the triangularly shaped closure panel extends over an access opening in the top wall of the carton and, may be torn away to expose such access opening thereby allowing a user to grip the closure panel in order to remove the latter.

BRIEF DESCRIPTION OF THE DRAWINGS

In the drawings, which form an integral part of the specification and are to be read in conjunction therewith, and in which like parts are designated by like reference numerals in the various views:

FIG. 5 is a perspective view showing upper areas of the carton of FIG. 3 just after filling the same with diapers and prior to closing thereof;

FIG. 6 is a perspective view of the carton of FIG. 5 after closing and sealing thereof;

FIG. 7 is a perspective view of the carton of FIGS. 5 and 6 showing an initial step in the removal of the tear-away closure panel;

FIG. 8 is a perspective view of the carton shown in FIGS. 5–7 with the tear-away closure panel removed to a greater extent;

FIG. 9 is a perspective view similar to FIGS. 7 and 8 but showing the tear-away closure panel completely torn away to its open position to reveal the dispensing opening in the front wall of the carton, and FIG. 10 is a perspective view corresponding to that of FIG. 9 but showing a plurality of diapers having been removed therefrom through the dispensing opening.

DETAILED DESCRIPTION OF THE INVENTION

Figure 1:
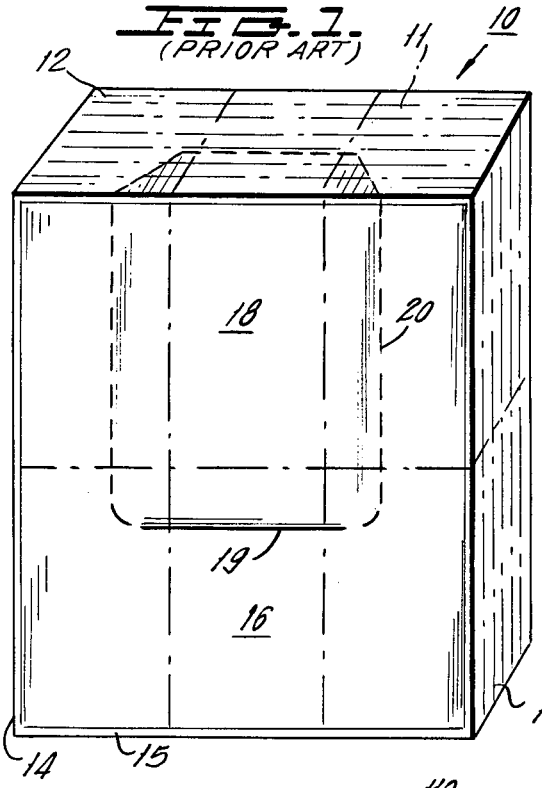
FIG. 1. (PRIOR ART)
FIG. 1 is a perspective view of one form of prior art carton particularly suited for containing a plurality of diapers from which one or more diapers may be simultaneously removed.

Referring first to FIG. 1, a typical prior art carton generally designated by the numeral 10 is provided with a top wall 12, side walls 13 and 14, a bottom wall 15, a front wall 16 and a rear wall extending essentially parallel to the front wall 16. The carton 10 contains a plurality of stacked rows of flexible, planar, rectangularly shaped articles such as diapers 11 which are disposed in face-to-face relationship to each other and form sets thereof extending between the front wall 16 and the rear wall.

A tear-away closure panel 18 is formed integral with the carton 10 and is partially defined by a pair of vertically extending, spaced apart, essentially parallel tear lines 20. The tear lines 20 extend past the upper edge of the carton 10 and into the top wall 12, while the lower opposite extremities of the tear lines 20 are connected by a fold line 19 in the front wall 16 which hingedly connects the closure panel 18 to the front wall 16. The closure panel 18 may be torn away from the front wall 16 along the tear lines 20 and swung forwardly to an open position about the fold line 19 to present a dispensing opening through which a plurality of the diapers 11 may be simultaneously removed from the carton 10. The resulting dispensing opening in the front wall 16 is essentially rectangular in shape and includes a width measured between the opposing, parallel tear lines 20 which exceeds that dimension of the horizontally extending, narrower edges of each of the diapers 11. Similarly, the dispensing opening includes a height dimension between the fold line 19 and the upper horizontal edge of front wall 16 which extends essentially the entire width of such opening and exceeds the height dimension, or longer edge of each of the diapers 11.

Thus, it may be readily appreciated that once the closure flap 18 is swung to its open position, a dispensing opening is presented which permits uncontrolled withdrawal of the diapers 11 from the carton 10 and results in inconvenience in two respects. First, the user may encounter difficulty in separating the individual diapers 11 in the sets thereof, particularly when only one hand is available to withdraw the diaper, consequently multiple quantities of the diapers 11 may be inadvertantly withdrawn when only a single diaper is desired. Secondly, in the case where a closure panel 18 is completely torn away from the carton 10, or where such closure panel 18 is left in an open position, the diapers 11 may fall out through the dispensing opening when the container 10 is transported, as within a diaper bag or the like.

Figure 2:
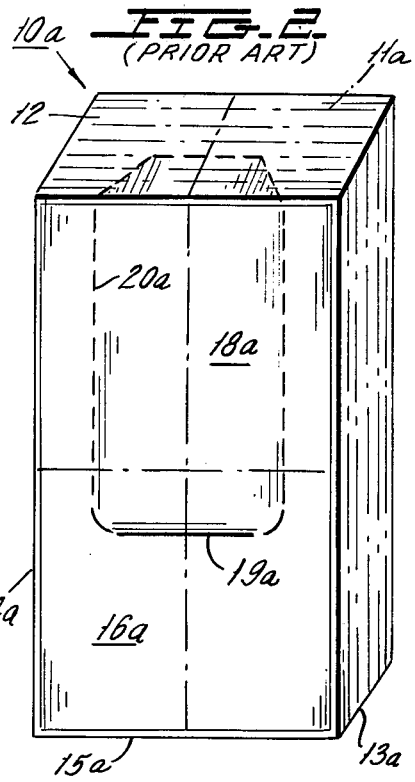
FIG. 2. (PRIOR ART)
FIG. 2 is a perspective view of another form of prior art diaper container in which one or more diapers may also be simultaneously removed.

Another form of prior art container indicated by the numeral 10*a* in FIG. 2, which is similar in construction to the container of FIG. 1, includes a top wall 12*a*, side walls 13*a* and 14*a*, a bottom wall 15*a*, and front wall 16*a* suitably connected together to form a rectangular shaped enclosure. A tear-away closure panel 18*a* defined in part a pair of vertically extending, parallel, spaced apart perforated score lines 20*a*, is essentially rectangular in shape and is hingedly connected to the front wall 16*a* along the fold line 19*a*. Although the width of the container 10*a* is such that only two sets of stacked rows of the diapers 11*a* may be contained therein in a manner in which the intersection of adjacent edges of the diapers 11*a* is vertically aligned with the longitudinal access of the closure flap 18*a*, the dispensing opening presented when the closure flap 18*a* is removed is essentially rectangular in shape and includes a height dimension exceeding the longer edge of each of the diapers 11*a*, and a width dimension which exceeds the length of the shorter edge of each of the diapers 11*a*.

Thus, it may be appreciated that even though none of the diapers in the sets thereof are geometrically aligned within the dispensing opening defined by closure flap 18*a*, once a number of the diapers 11*a* are removed from the carton 10*a*, one or more of such remaining diapers 11*a* may shift to a position in geometrical alignment with the dispensing opening and unintentionally fall out through the latter.

From the foregoing, it becomes apparent that the closure panels 18 and 18*a* illustrated in FIGS. 1 and 2 are merely employed as tear-away flaps to gain quick access to the interior of a carton and do not function to control diaper dispensing from cartons.

Figure 3:
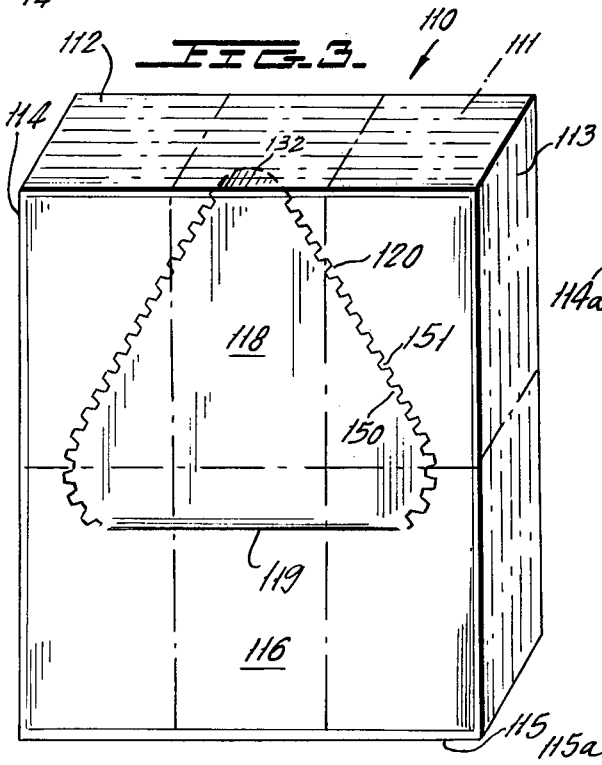
FIG. 3 is a perspective view of a carton which forms the preferred embodiment of the present invention, prior to opening thereof, a plurality of stacked. rows of diapers being indicated in the phantom.

Turning attention now to FIG. 3, a rectangularly shaped carton 110 similar in dimensions and construction to the carton 10 illustrated in FIG. 1 is provided with a novelly configured dispensing opening which eliminates the shortcomings of the prior art constructions shown in FIGS. 1 and 2 and provides controlled, one-at-a-time dispensing of diapers therefrom. The carton 110 contains a plurality of diapers 111 therewithin which are disposed in stacked rows thereof and are aligned in front-to-back, face-to-face relationship to each other. Carton 110 includes a top wall 112, opposed, parallel side walls 113 and 114, a front wall 116, bottom wall 115 and rear wall (not shown). A tear-away closure panel 118 defined by a tear line 120 in the front wall 116 is generally triangular in shape and has the base side thereof defined by a fold line 119 adjacent the bottom wall 115 and extending parallel to the latter.

The two remaining sides of the closure panel 118 extend upwardly from the opposite extremities of the fold line 119 and toward each other to spaced apart points along the top edge of the front wall 116 whereby to form, in effect a symmetric trapezoidal shape in the front wall 116. The opposite extremities of an arcuate of angularly shaped score line 132 in a forward central section of the top wall 112 connect the tear lines 120 and whereby to define a triangularly shaped apex portion of the closure panel 118. Score line 132 may comprise a plurality of spaced apart cut lines in the top wall 112. However, the tear lines 120 comprises a zig-zag pattern forming a plurality of alternately inverted U-shaped, connected scores in the front wall 116 which define interlocking extensions 150 and 151.

The front-to-back sets of the diapers 111 are stacked in three adjacent, abutting columns comprising a top and bottom row whereby a rectangularly shaped matrix of six diaper faces oppose and abut the interior surface areas of the front wall 116. The closure panel 118 is arranged on the front wall 116 such that a normal line extending from the fold line 119 perpendicularly upward to the opposing apex of the closure panel 118 is aligned with a vertical reference axis dividing the front wall 116 into two equal halves. Fold line 119 is spaced slightly below a horizontally extending reference axis dividing the front wall 116 into equal top and bottom halves.

Closure panel 118 has a maximum vertical dimension which is measured from the mid point of the fold line 119 to the top edge of the front wall 116 between the adjacent upper extremities of tear line 120, which dimension exceeds the length of the longest (vertical) edge of one of the diapers 111. As is readily apparent from the drawings, however, closure panel 118 further includes a vertical dimension on opposite horizontal sides of the above-mentioned maximum dimension, which is measured between the fold line 119 and intermediate sections of each of the tear lines 120 and is less in magnitude than the length of the longest edge of one of the diapers 111.

Figure 4:
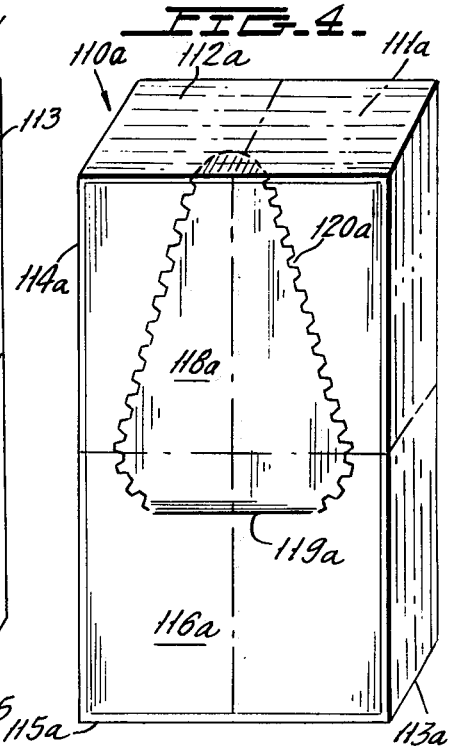
FIG. 4 is a perspective view of an alternate form of the present invention, prior to opening there of and showing the diapers contained therein in phantom.

A carton 110*a* shown in FIG. 4 is essentially identical in overall size and shape to the prior art carton 10*a* of FIG. 2 and comprises a top wall 112*a*, side walls 113*a* and 114*a*, bottom wall 115*a*, a front wall 116*a* and a rear wall (not shown). The carton 110*a* is adapted to contain a plurality of diapers in sets thereof which are arranged in two adjacent columns comprising a top and bottom row thereof, whereby a rectangularly shaped matrix comprising four faces of the diapers 111*a* oppose, and abuttingly contact the interior surfaces areas of the front wall 116*a*. A triangularly shaped closure panel 118*a* has the base side thereof defined by a fold line 119*a* which extends essentially parallel to, and is slightly spaced below, a horizontal reference axis bisecting the front wall 116*a* into two equal, upper and lower parts. The remaining sides of the closure panel 118 are defined by tear lines 120*a* similar in construction to the tear lines 120 discussed above with reference to FIG. 3. The closure panel 118*a* is essentially identical in all other respects to closure panel 118 of carton 110 described above and is geometrically located in the front wall 116*a* similar to the location of closure panel 118 in front wall 116.

Attention is now directed to FIGS. 5–10 wherein the carton 112 is depicted in various states of use. As shown in FIG. 5, the top wall 112 may comprise a plurality of panel members foldably connected to the respectively associated side walls 113 and 114, front wall 116 and the rear wall (not shown); prior to folding the top wall 112 panels into overlapping relationship with each other to complete the erection of carton 112, sets of the diapers 111 are inserted into the three adjacent columns of top and bottom stackes thereof. After filling the carton 110 with diapers, the smaller end panels of the carton are folded over into overlaying relationship to the diapers 111, followed by successive folding of the larger, front and back panels to form the enclosed carton in FIG. 6.

The carton 112 may be provided with any of various types of a carrying handle 140 in the top wall 112 to facilitate carrying the carton 110 with a single hand. In use, when the carton 110 is initially opened for use, the consumer applies downward pressure with the fingers to that portion of the closure panel 118 defined by the score line 132 in the top wall 112 tearing such portion away from the top wall 112 and forming an access opening in the top wall 112 which allows the user to grasp such upper portion of the closure panel 118. While firmly gripping the upper portion of the closure panel 118 such portion is pulled outwardly away from front wall 116 and downwardly to produce tearing between the closure panel 118 and the adjacent edges of the front wall 116 along the tear lines 120, until the closure panel 118 is torn downwardly to the position thereof shown in FIG. 9 whereby to produce a generally triangularly shaped dispensing opening 122 in the front wall 116.

The resulting dispensing opening 122 provides an opening having a maximum vertical dimension which exceeds that of the longer edge of one of the diapers 111 and intermediate vertical dimensions on opposite lateral sides of the maximum dimensions which are less in magnitude than the longer edge of each of the diapers 111. Sections of the edges in the front wall 116 defining the dispensing opening 112 extend obliquely with respect to the edges of each of the diapers 111 facing the front wall 116, while sections of the front wall 116 surrounding the dispensing opening 122 overlap at least portions of the face of each of the diapers 111 whereby to normally block withdrawal of such diapers 111 through the dispensing opening 122, unless a user seizes an individual one of the diapers 111 and forceably draws the selected diaper through the opening 122, whereupon the selected diaper deforms in shape and slidably engages the edges defining the diapensing opening 122 until the selected diaper clears such edges and is completely removed from the carton 110.

Assuming now that a number of the diapers 11 in the upper stack of the middle column have previously been removed as indicated in FIG. 10, those adjacent diapers 111 in the upper stacks thereof are prevented from accidently falling out through the dispensing opening 122, even if such adjacent diapers shift to the central position aligned with the opening produced by the previous removal of such diapers 111, by virtue of the fact that the upper edges of the front wall 116 defining the dispensing opening 122 overlap the upper corners of the empty space created by the removed diapers 111 and consequently block the corresponding upper corners of one of the adjacent diapers 111 which has shifted into the empty space thereby preventing such diaper from accidently falling through the dispensing opening 122.

In a similar manner, the novelly configured dispensing opening 122 allows the user to grasp at least a corner of each of the front faces of the diapers 111 adjacent the front wall 116 while at the same time blocking other portions of such diaper faces and preventing the same from being removed from the carton except on those occasions when the user grasps and forceably removes one of the same. In this manner, the dispensing of the diapers 111 from the container 110 is controlled to prevent indiscriminate removal of the diapers 111 and facilitates one-at-a-time diaper dispensing since those sections of the front wall 116 surrounding the dispensing opening 122 engage portions of the face of each of those diapers drawn into engagement with the interior surface of the front wall 116.

The function and operation of the carton 110*a* of FIG. 4 is essentially identical to that of carton 110 shown in FIGS. 5–10. It is to be noted that the access opening defined by the upper portion of the closure panel 118 further allows a user to grasp the edge of individual ones of the diapers in the set thereof in the upper stack of the central column of diapers 111.

The carton 110 may be reclosed after use by swinging the closure panel 118 about the fold ling 119 to a closed position essentially coplanar with the front wall 116 and forcing the interlocking extensions 150 into engagement with and slightly past the corresponding extensions 151 of the wall 116 whereby to frictionally lock the closure panel 118 in a closed position until additional diapers wish to be withdrawn from the carton 110.

It should be observed here that although the dispensing opening 122 is disclosed herein as being generally triangular or trapezodial in shape it is recognized that other regular or irregular polygonal shapes falling within the scope of the appended claims may be employed to produce the desired controlled dispensing provided by the present invention. It is therefore recognized that those skilled in the art may make various modifications or additions to the preferred embodiment chosen to illustrate the invention without departing from the gist and essence of the present contribution to the art. Accordingly, it is to be understood that the protection sought and to be afforded hereby should be deemed to extend to the subject matter claimed and all equivalents thereof fairly within the scope of the invention.

What is claimed is:

1. In combination with a plurality of flexible rectangularly shaped, generally planar articles, said articles being arranged in aligned, face to face abutting relationship, and in stacked rows and columns presenting a rectangular matrix of adjacent faces of said articles, an upstanding dispensing carton which facilitates the removal of single articles comprising:

a top, bottom, front, back and end walls joined together for enclosing said articles therein with the adjacent planar faces of said articles in said matrix being in opposed, essentially parallel relationship to said front wall, and said front wall including a symmetric trapezoidal closure panel being at least partially removable from said front wall to create a similarly shaped dispensing opening, with the base side of said closure panel being connected to said front wall by a fold line forming a hinged connection, and with the remaining sides of said closure panel being defined by tear lines extending obliquely to the side edges of the front wall and consisting of notched interlocking extensions in both said closure panel and said front wall to establish reclosure means for said closure panel, the sides of said closure panel extending upwardly from the opposite extremities of said fold line towards each other throughout their length and terminating in spaced apart points along the top edge of said front walls, the height of said dispensing opening measured along an imaginary line perpendicular to the center of the base of said dispensing opening to the opposed top edge thereof is greater than the height of one of said rectangular articles and wherein the width of said dispensing opening measured along the base of said opening is greater than the width of one of said articles, the width of said dispensing opening measured along an imaginary line parallel to said base and adjacent said top edge is less than the width of one of said articles, and a vertical dimension on opposite horizontal sides of the imaginary perpendicular line to intermediate sections of each of the sides of said closure panel is less than the height of one of said rectangular articles, whereby when said closure panel is opened to define said dispensing opening, an article may be removed from within said carton only by twisting and deforming said articles to fit through said dispensing opening such that the dispensing of articles is controlled and the likelihood of the articles accidentally falling out of said opening is substantially reduced, and an access panel in said top wall of said carton adjacent said front wall for tearing said closure panel along said tear lines, said access panel being defined by an extension of each of said oblique tear lines in said top wall joined by an arcuate score line defining a triangularly shaped apex portion of the closure panel.

* * * * *